United States Patent [19]

Beard

[11] 4,444,339

[45] Apr. 24, 1984

[54] TILTABLE VALVE EMPLOYING A MOVEABLE CUP

[76] Inventor: Walter Beard, South St., Middlebury, Conn. 06762

[21] Appl. No.: 454,710

[22] Filed: Dec. 30, 1982

[51] Int. Cl.[3] ..... B65D 83/14

[52] U.S. Cl. ..... 222/402.22; 222/402.21

[58] Field of Search ..... 222/402.21, 402.22, 222/402.23, 402.24; 251/349

[56] References Cited

U.S. PATENT DOCUMENTS

| | | | |
|---|---|---|---|
| 2,473,704 | 6/1949 | Garretson | 251/349 X |
| 2,709,111 | 5/1955 | Green . | |
| 2,731,298 | 1/1956 | Green . | |
| 3,060,965 | 10/1962 | Taggert . | |
| 3,547,405 | 12/1970 | Ewald . | |
| 3,572,557 | 11/1967 | Graham et al. | 222/402.22 |
| 3,635,379 | 1/1972 | Angele . | |
| 3,666,148 | 5/1972 | Webster | 222/402.22 X |

*Primary Examiner*—Joseph J. Rolla
*Assistant Examiner*—Thomas C. Fitzgerald
*Attorney, Agent, or Firm*—Hill, Van Santen, Steadman & Simpson

[57] ABSTRACT

A stem tiltable valve assembly whose valve body is provided with a reciprocally moveable stem actuated cup member that incorporates a resilient gasket which makes sealing engagement with a related complementary member of the valve assembly. The valve assembly provides a capability for a maximum dispensing flow through the valve assembly when the valve stem is tilted to open the valve.

16 Claims, 6 Drawing Figures

TILTABLE VALVE EMPLOYING A MOVEABLE CUP

BACKGROUND OF THE INVENTION

1. Field of the Invention

This invention lies in the field of valves actuated by stem movements and particularly to combinations of a moveable valve stem with a moveable cup member.

2. Description of the Prior Art

In the art of aerosol-type valves, it has been heretofor appreciated in the art that tiltable valve assemblies adapted for the dispensing of highly viscous fluids from pressurized containers can be provided which have a moveable cup member. This moveable cup member is axially reciprocated within the valve assembly by tilting movements of the moveable stem member, yet, when the valve is in a normally closed position, a positive sealing action is obtainable between the moveable cup member and a gasket means in the valve assembly (see, for example, my pending U.S. patent applications Ser. Nos. 394,517 filed July 2, 1982; 405,685 filed Aug. 5, 1982; 405,696 filed Aug. 5, 1982; 432,298 filed Oct. 1, 1982; 438,212 filed Nov. 1, 1982; 442,636 filed Nov. 18, 1982; and 452,953 filed Dec. 27, 1982.

One possible problem which such previous stem tiltable moveable cup equipped valve assemblies might experience occurs when one is trying to maximize the cross-sectional internal size of the tiltable stem member in relation to other components of the valve assembly. In actual commercial practice, the valve body is standardized, particularly as regards its outer or peripheral dimensions, so as to enable rim portions of the valve body to matingly engage with the mouth of a preformed container and be connected therewith by collet fingers which crimp a peripheral portion of the valve body to the (typically) rolled edge portions of the container. Because of the inherent working space requirements currently required for use of collet fingers to secure the valve body to the container mouth, the outside diameter of the central pedestal existing in the valve body is limited to provide the required radial spacing needed between it and radially outer rim portions of the valve body. This means that the internal diameter of the pedestal body must be used to a maximum extent for achieving valve function and at the same time permit the cross-sectional internal area of the moveable stem to be maximized.

I have now discovered that one technique which may be employed in order to maximize, if desired, the internal diameter of a valve stem in such a valve assembly is to eliminate the heretofore employed upstanding rib member provided peripherally on the plate portion of the moveable cup member. In previous moveable cup members, such an upstanding rib member has always, to the best of my information and belief, been employed as a means for seating the moveable cup member against a resilient gasket member supported in the pedestal portion of the valve body. If this upstanding rib member could be eliminated, there then would result a capability for enlarging and maximizing the cross-sectional internal diameter of the moveable valve stem member, provided, of course, such rib member elimination is achieved without sacrificing sealing capability in the resulting valve structure and without sacrificing other desired valve characteristics, such as high flow capability, or the like, if desired.

So far as I am aware, no one heretofor has sought to provide a high flow capacity, stem tiltable, moveable cup-equipped, aerosol-type valve assembly wherein the internal cross-sectional area of the moveable stem is maximizable and wherein the moveable cup member has no valve-seating upstanding rib member.

BRIEF SUMMARY OF THE INVENTION

This invention is directed to a new and improved tiltable valve assembly adapted for the dispensing of highly viscous fluids from pressurized containers. Such valve assembly can be manufactured in an assembled configuration, subsequently stored, and then assembled as a unit onto a desired pressurizable container without any further valve assembly modification.

The present invention is more particularly directed to a stem tiltable valve assembly incorporating a fixed valve body and a moveable cup member which member is characterized by the feature that the plate portion thereof is provided along peripheral regions thereof with a resilient gasket member. This gasket member is adapted to achieve directly or indirectly a positive sealing action between itself and the adjacent surface portions of component(s) associated with the valve body. In such valve assembly, a second resilient gasket member is also provided and such is disposed about the base of the tiltable valve stem and its (internal) terminal flange adjacent the main valve body. This second gasket member also generally serves not only to guide and support the moveable stem member in a central valve closed configuration and also during valve stem tilting operations which occur during valve opening, but also to seal the region between the valve body and the tiltable stem. Internal container pressures, and/or supplemental yielding bias means, provide means serving to return the moveable stem member to an upright configuration at the close of a valve opening operation.

Accordingly, one object of the present invention is to provide a high flow capacity, stem tiltable valve assembly whose valve body is provided with a reciprocally moveable stem actuated cup member which cup member incorporates a resilient gasket means that extends about the periphery of the plate portion of the moveable cup and that makes sealing engagement with a related complementary member of the valve assembly while providing a capability for a maximum dispensing flow through the valve assembly when the valve stem is tilted to open the valve.

Another object of the present invention is to provide a high flow capacity, stem tiltable, moveable cup equipped valve assembly wherein the stem member is capable of having a maximized internal cross-sectional area and wherein the moveable cup member has no valve-seating upstanding rib member.

Another object of the present invention is to provide a moveable cup equipped, stem tiltable valve assembly which is provided with two gasket members which can coact with one another in combination with other valve components to provide valve opening and closing capabilities.

Another object of the present invention is to provide a high flow capacity stem tiltable valve assembly whose valve body is provided with a reciprocally moveable, stem actuated cup member having a just resilient gasket means that seats against another resilient gasket supported by the valve body to provide valve function.

Another object of the present invention is to provide a valve assembly with a moveable cup arrangement with first gasket as just above indicated wherein such first gasket seats against one side of a terminal flange of such stem and a second gasket supported by the valve body seats against the opposed side of such flange to provide valve function.

Another object of the present invention is to provide a high flow capacity stem tiltable valve assembly whose valve body is provided with a gasket equipped reciprocally moveable stem activated moveable cup member and wherein such moveable cup member is adapted to make seating engagement with an opposing rib member formed in such valve body to provide a major valve function.

Another object of the present invention is to provide a high flow capacity stem tiltable valve assembly whose valve body is provided with a gasket equipped reciprocally moveable stem actuated moveable cup member and wherein such moveable cup member is adapted to make seating engagement with an opposable rib member formed in the terminal flange of the tiltable stem to provide a major valve function.

Other and further objects, aims, purposes, features, and the like will be apparent to those skilled in the art from the teachings of the present specification taken together with the accompanying drawings.

DETAILED DESCRIPTION

Figure 1:
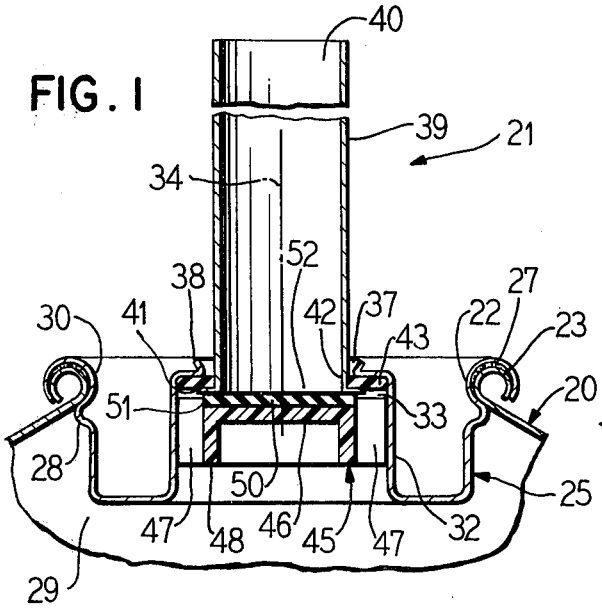
FIG. 1 is an enlarged vertical sectional view of one embodiment of a valve assembly of the present invention shown in functional association with a fragmentarily drawn container.
Figure 2:
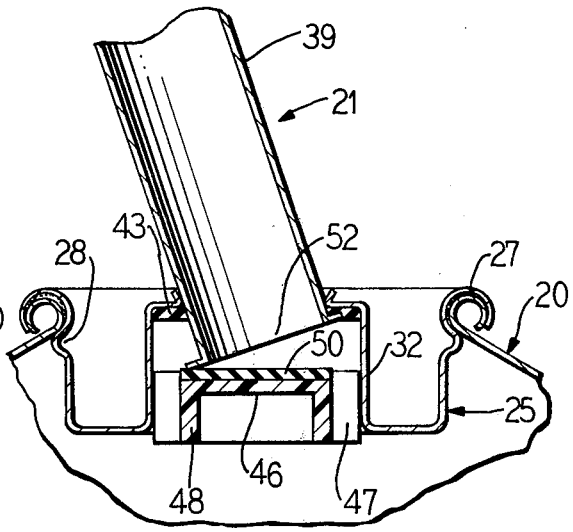
FIG. 2 is a view similar to FIG. 1, but showing the valve structure in an open (stem tilted) configuration.

Referring to FIGS. 1 and 2, dispensing container or can 20 shown fragmentarily is fitted at its top end with a tilt valve structure 21 of the present invention. Container 20 is provided with an axially located aperture 22 having a rolled perimeter 23, container 20 being formed in this instance of sheet metal. Container 20 uses conventional construction and forms no part of the present invention as such.

Tilt valve structure 21 includes a preferably metallic mounting cup 25 which terminates in a rolled perimeter 26 that is adapted to make nesting engagement with the rolled perimeter 23. Interior surfaces of the rolled perimeter 26 are provided with a coating 27 formed a resilient sealing material of resilient, elastomeric plastic composition, such as a chloroprene rubber composition, or the like, so that, when the mounting cup 25 is fitted over the rolled perimeter 23 and formed by collet fingers, there is produced a retaining crimp 28 in cup 25, and the preformed valve structure 21 is thus sealingly associated with the container 20. Charging of container 20 with a pressurized fill is conventionally accomplished, as those skilled in the art will readily appreciate.

While the valve structure 21 is particularly well suited for the dispensing of a viscous fluid from a chamber 29 of the container 20, the valve structure 21, as those skilled in the art will readily appreciate, is also suitable for the dispensing of a viscous fluid which may have admixed therewith a gaseous propellent.

As those skilled in the art will appreciate, the internal diameter of an aperture 30 defined by the rolled perimeter 23 can be standardized in the valve trade while the mounting cup 25 is so formed as to have an inner wall member 32 integrally formed with a central portion 33. Wall member 32 can have a diameter and an axial length as particularly chosen for an individual type of valve structure 21 desired.

Through the center of portion 33 and along the axis 34 of the mounting cup 25 is an aperture 37 which can be optionally provided with an upstanding lip 38 which serves as a stiffening or reinforcing means about the aperture 37.

Through the aperture 37 is extended a nozzle stem member 39 which, at its upper end portion, is provided with a dispensing orifice 40, and which, at its opposite input end portion, is provided with a radially outwardly extending flange 41 that is here integrally formed with the nozzle stem member 39. The nozzle stem member 39 extends also through a central aperture 42 of a resilient elastomeric gasket 43 which gasket 43 also makes abutting contact with both adjacent outer wall portions of the nozzle stem member 39 and the flange 41. The outer perimeter of the gasket 43 is seated in the inner wall member 32 adjacent the central portion 33 of the mounting cup 25. The nozzle stem member 39 is normally in the upright (valve closed) configuration illustrated in FIG. 1.

Particularly when the internal cross-sectional area of the nozzle stem member 39 is to be maximized, the nozzle stem member 39 is formed of metal so as to achieve a thinnest practical wall thickness for stem member 39 consistent with structural strength needs for a stem member 39 so that a stem member 39 can be tilted in a valve structure 21 and the valve thereby opened without injury to the stem member 39. Tube stock may be used as a starting material for a stem member 39; thus after being cut to length, one end is conveniently formed to provide the desired flange 41. Plastic can be utilized of course, for a stem member 39, where use consideration permits as those skilled in the art will readily appreciate.

A maximized nozzle internal diameter is desired when it is intended to reduce flow restrictions within stem 39 and valve 21 and to achieve a maximum quantity of fill flow from chamber 29 at any given time through stem 39 and valve 21.

Further, a bigger internal diameter nozzle permits acheivement of an accumulator function. For example, in a nozzle with a one quarter inch stem inside diameter, a strip of fill (such as a calking compound) can be laid down as a worm or spaghetti. If the valve is cut off and replaced by a one half inch stem, the flow rate remains the same as on the original one quarter inch stem, but there is now laid down a one half inch diameter worm or spaghetti. Thus, the term accumulator function used herein means that more fill material can be laid down per linear inch within the same time period when a valve is open, also the flow rate potential is greater.

A moveable cup member 45 is disposed for axial sliding movements in the region enclosed by inner wall member 32 of the cup 25. The moveable cup member 45 includes a valve plate 46 which extends across the top region thereof. Integrally associated with the valve plate 46 are a plurality of radially (relative to plate 46) outwardly extending guide ribs 47 which are configured so as to be generally equally sized and generally equally circumferentially spaced from one another, and the radially outer edges of each rib 47 are configured so as to be in a spaced, adjacent, or even optionally contacting, slidable relationship with respect to adjacent portions of the wall 32. In the embodiment shown, the guide ribs 53 extend axially downwardly (towards chamber 29) and rearwardly away from the valve plate 46 to an extent sufficient to stabilize sliding movements of the moveable cup member 45 relative to the mounting cup 25 and prevent cocking of the valve plate 46.

Similarly downwardly and rearwardly extends a circumferentially continuous apron 48 integrally from the valve plate 46 in a radially inwardly spaced relationship relative to the outer edges of ribs 47. The principal purpose of this apron 48 is to provide support and point of attachment for the adjacent radially inner terminal portions of individual ribs 47, thereby to provide a reinforcing means for the ribs 47 and the plate 46 in the moveable cup member 25.

On the upper surface of valve plate 46 is laid a resilient gasket member 50 which optionally can be adhered to the upper surface of valve plate 46 by an adhesive, or the like (not shown).

Individual ribs 47 are longitudinally (relative to axis 34) raised slightly relative to the upper surface of valve plate 46 thereby to provide retaining means or shoulders 57 for the gasket member 50 which is thus received within a pocket-like region over the upper face or surface of valve plate 46. This arrangement is believed to be preferable to prevent lateral shifting of the gasket such as might occur during a tilting of stem member 39.

The gasket 50 can be configured so as to be toroidally configured if desired, but, as those skilled in the art will appreciate, if a solid disk configuration is employed for the gasket 50, then the central portion of the gasket could serve to minimize or avoid plastic flow and to increase the area of bonding between gasket 50 and plate 46.

The flange 41 of stem 39 preferably has a radial extent which is such as to cause same to extend radially beyond the plate 46 of the moveable cup member 25 (as in the embodiment shown in FIGS. 1 and 2) so that the outer edge of the flange 41 can bear against or work against the body moveable cup member 25 when the moveable cup member 25 is in a tilted configuration as shown in FIG. 2 which tends to save wear and avoid scuffing action on the surface of the underlying adjacent gasket 50 disposed on the face of the valve plate 46.

When the stem 39 is in the normally closed configuration shown in FIG. 1, the gasket 50 makes a seating engagement with the adjacent lower surface of the flange 41. The thickness of the gasket 50 is chosen so as to be greater than the raised height of adjacent rib shoulders 51 to insure unimpeded seating between gasket 50 and flange 41. A primary seal is thus formed between stem 39 (and flange 41) and moveable cup 45 (and gasket 50) which holds the fill in chamber 29 of container 29 when the stem 39 is in the upright position.

Also, when the stem 39 is in such normally closed configuration shown in FIG. 1, the gasket 43 makes a seating engagement with the adjacent upper surface of the flange 41. A secondary seal is thus formed between the stem 39 (and flange 41) and mounting cup 25 (and gasket 43) which holds the fill in chamber 29 of container 20 when the stem 39 is in the upright position.

When the stem 39 is tilted, as shown for example in FIG. 2, the moveable cup member 45 is axially moved downwards within the region enclosed by inner wall member 32 of cup 25 through a camming action exerted thereon specifically by the edge of flange 41, thereby separating the flange 41 from the respective gaskets 50 and 43 and opening the valve assembly 21 for passage of fill therethrough from chamber 29 along opposing sides of ribs 47 and into the mouth 52 of stem 39 for passage therethrough and out orifice 40.

Valve closing is achieved by returning stem 39 to its upright configuration. In valve assembly 21, the internal pressure within container 20 provides a yielding bias urging movement of moveable cup 45 and stem 39 into a seating engagement with gaskets 50 and 43.

Thus, the valve structure 21 provides, for a valve cup of fixed diameter, a capability for achieving a larger internal diameter in the stem 39 than is achievable in a prior art valve structure of the moveable cup type wherein a peripheral upstanding rib on the valve plate portion of the valve plate portion of the moveable cup is used to seat against a gasket member because, in the valve structure 21, the need for such a peripheral upstanding rib is substantially completely eliminated. The upstanding rib provides a limit upon the size of the internal diameter of a nozzle. At the present time in this valve art, the external diameter of a valve cup 25 is standardized and this fixes the maximum diameter of the central pedestal portion defined by inner wall member 32 (and thus the maximum internal diameter of stem 39) since room or radial spacing is needed between such pedestal portion and the radially outer wall portions of valve cup 25 in order to extend into such spacing collet fingers for purposes of crimping and thereby mounting valve cup 25 relative to container 20 after cup 25 has been positioned on the container 20.

Figure 3:
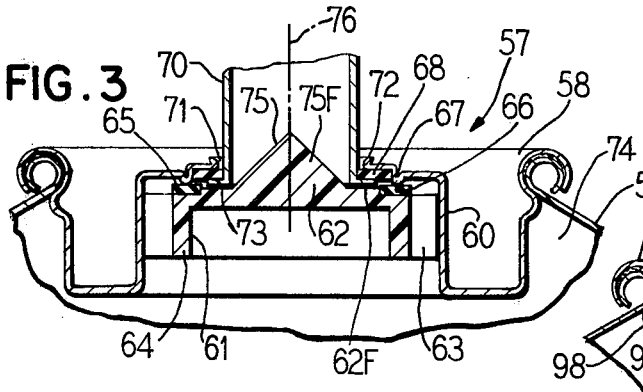
FIG. 3 is a view similar to FIG. 1, but showing an alternative embodiment of a valve structure of the present invention.

Referring to FIG. 3, there is seen another embodiment of a valve structure of the present invention which is designated in its entirety by the numeral 57. Like valve structure 21, the valve structure 57 employs a mounting cup 58 whose rolled perimeter is similarly mounted to a container 59 and within whose pedestal 60 is positioned a moveable cup member 61 with integrally formed valve plate 62, guide ribs 63, and apron 64.

The peripheral top facial edge portions 65 of the face of valve plate 62 are recessed and fitted with a gasket 66. Preferably this gasket 66 is adhered into the recess 65 by an adhesive (not detailed). This gasket 65 is adapted to make primary sealing and seating engagement with an opposed circumferentially extending rib 67 formed into the top portion of the pedestal 60. The rib 67 is positioned so as to be circumferentially adjacent the outer circumferential region of a gasket 68 through which the stem 70 (shown fragmentarily) extends, the stem 70 being structured similarly to the nozzle stem member 39. Like gasket 43, the gasket 68 is seated in the pedestal 60 adjacent the upper surface thereof. Like cup 25, the mounting cup 58 is provided with a central aperture 71 and has an upstanding lip 72 through which the nozzle stem member 70 projects.

Thus, in valve structure 57, a primary seal is produced between the gasket 66 and the rib 67 while a secondary seal is achieved between the gasket 68 and adjacent portions of the stem 70 and its flange 73. The secondary seal involving gasket 68 functions primarily to prevent a bypassing of a fill from chamber 74 within container 59 when the stem 70 is tilted and the valve structure 57 is in its open configuration with a space existing between the gasket 66 and the rib 67. In addition, the gasket 68 serves as a means for supporting the nozzle stem member 70.

One of the features associated with valve structure 57 is that the terminal flange 73 of stem 70 is operatively engaged with the top surface of the valve plate 62 when valve 57 is in its closed configuration (as shown in FIGS. 3) which may be desirable in preventing any lateral shifting of gasket 66.

The moveable cup member 61 is further provided with a centrally located integrally formed camming member 75 positioned on valve plate 62 [and preferably (and as shown) being integrally formed therewith]. Valve plate 62 has a flat annular face 62F positioned peripherally about camming member 75, the face 62F being adapted to mate generally with the opposing face of flange 73 of nozzle stem member 70. The face 75F of camming member 75 is inclined relative face 62F, the angle of inclination relative to face 62F being generally greater than 0° smaller than about 70° with a presently preferred such angle falling in the range from about 30° to 60° . This camming angle of inclination is generally one which will permit the transverse tilting motion of the nozzle stem member 70 (which motion occurs during opening and closing of the valve 57) to be converted into vertical movement of moveable cup member 61 with the position of the cup member 61 being predictably determined by the position of stem member 70 at any given time.

The face 75F is generally radially symmetrical about the axis 76 of valve structure 57. The surface configuration of face 75F can be, for examples, conical, spherical, egg-shaped, or the like. The effect of camming member 75 is to magnify the extent of downward travel of moveable cup member 61 to an unexpected and surprising extend during valve opening, thereby to increase in a highly desirable manner the opening 61 formed between rib 67 and gasket 68 when valve 57 is in an open configuration. The surface configuration of face 75F in any given embodiment can be chosen so as to achieve a particular effect, such as making 70 have a size considered to match the size of the passageways between circumferentially ribs 63 in the vicinity of such an opening.

A crimped portion (not detailed) may be formed about the mouth 59 of pedestal 60, by collet fingers or the like in the valve assembly, so as to provide a stop means limiting extent of axial slidable movements of the moveable cup member 61 relative to pedestal 60. Thus, the assembly of the valve structure 57 can remain integral during storage and after assembly onto a container 59, or the like.

When an external operating deflecting force is applied against the outer or tip end of the nozzle stem member 70, the flange 73 is, in a first phase of valve operation, moved against the valve plate 62, thereby causing the movable cup member 61 to slidably move [towards crimped portion about the mouth 59] resulting in the unseating and separating of the rib 67 relative to the gasket 68 and forming a first phase opening therebetween.

With a further inclination or tilting or nozzle stem member 70, the edge of flange 73 slidably moves along the face 75F of camming member 75 away from face 62F of valve plate 62. As such sliding movement occurs, moveable cup member 61 is caused to move further away from rib 67. Thus, the size of the opening is increased very substantially, to complete a second phase of valve opening, thereby permitting pressurized contents in the container 59 to flow upwardly and outwardly through the nozzle stem member 70. In normal operating configuration, after such an opening of the valve structure 57, there results a flow of the pressurized contents from within the container 59 in a laminar manner through the clearance passageways between ribs 63 and into and through the nozzle stem member 70.

As can be seen, one effect of camming member 75 is to accelerate the opening rate or rate at which moveable cup member 61 is separated from rib 67 during a tilting of nozzle stem member 70 compared to the corresponding opening rate achievable with no camming member 75 and with a flat face across valve plate 62. Another effect of camming member 75 is to increase substantially the size of the opening formed between moveable cup member 61 and rib 67 compared to the corresponding opening achievable with no camming member 75 and a flat face across valve plate 62. The quantitative comparative difference in opening size is set by the distance which flange 73 is elevated from valve plate 62 by the configuration resulting from a given camming member 75. A further effect of camming member 75 is to increase the potential flow rate of material to be discharged from container 59 through valve 57 since, for a given valve 57 configuration, the larger the valve opening the greater is the flow rate and volume through valve 57 up to some maximum valve. A still further effect of camming member 75 is to enable one to regulate the size of the valve opening relative to the size and configuration of passageways between ribs 63 so as to provide, for example, a particularly optimized interrelationship therebetween, such as may be desirable for dispensing a particular type of material. Yet a further effect of camming member 75 is to permit a maximization of movement of moveable cup member 61 along axis 76 relative to a given amount of tilt movement of nozzle stem member 73 which can be important for a given valve configuration of the moveable cup type where inherent limits of design can sometimes be a consideration, such as the extent to which, for example, a given nozzle stem member 73 can be inclined in a valve 57 relative to lip 72.

When valve closure is desired, the tip end of stem 73 is allowed to return to its normally upright configuration which effects a reversal of the operations described above and which thus effectuates a resealing between the rib 67 and the gasket 68. The resealing is effectuated in the embodiment shown by the interior pressure exerted upon the underside of the moveable cup member 48 from the pressurized fill contents in container 59.

Figure 4:
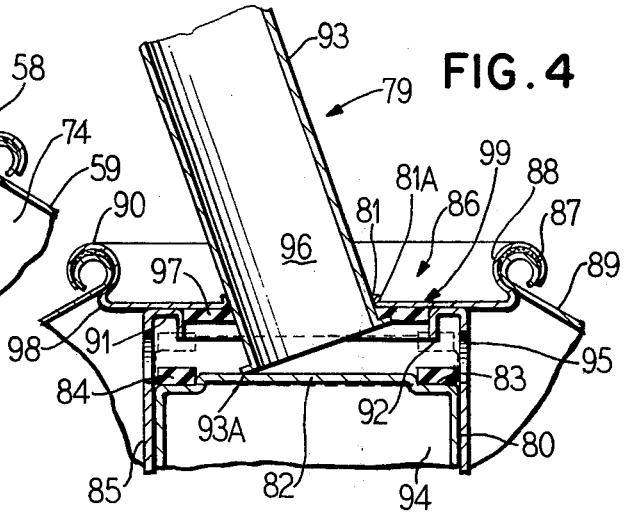
FIG. 4 is a view similar to FIG. 2, but showing a further alternative embodiment of a valve structure of the present invention.

Referring to FIG. 4, there is seen another embodiment of a valve structure of the present invention which is designated in its entirety by the numeral 79.

The tilt valve structure 79 includes a metallic mounting plate 86 which terminates in a rolled perimeter 87 that is adapted to make nesting engagement with the rolled perimeter 88 about the mouth of container 89.

Interior surfaces of the rolled perimeter 87 are provided with a coating 90 formed of a sealing material comprised of a resilient elastomeric plastic composition, such as chloroprene rubber or the like, so that, when the mounting plate 86 is fitted over the rolled perimeter 88 and crimped thereto by collect fingers, there is produced a retaining crimp 98 in plate 86 and the performed valve structure 79 is thus sealingly associated with the container 89.

The central portion of the mounting plate 86 is provided with an integrally formed cover plate region 99 which includes a centrally defined aperture 81 which has circumferentially defined thereabout an upwardly and outwardly formed rigidifying flange 81A. Depending from the mounting plate 86 in aligned relationship to the cover plate region 99 is a cross-sectionally circularly shaped member 85 that is provided with an inturned and also terminally down turned rim flange 91 which is secured in face to face engagement with the interior or bottom face of the plate 86 by means of welding, adhesive, or the like, as desired. The internal central bottom face of the cup member 85 if desired may be provided with an aperture (not shown) equipped with an in-turned rim flange (not shown).

Disposed for axial sliding movements within the tubular side wall portions of the cup member 85 is a moveable cup member 80. Through the aperture 81 of the plate region 99 is extended a nozzle stem member 93 which at its upper end portion is provided with a dispensing orifice (not detailed) and which at its opposite end portion is provided with a radially outwardly extending flange 93A that is here integrally formed with the nozzle stem member 93. The nozzle stem member 93 extends also through a central aperture of a resilient elastomeric gasket 97 which gasket 97 also makes abutting contact with both adjacent outer wall portions of nozzle stem member 93 and the flange 93A. The gasket 97 is seated in the central portion of the mounting plate 86. The nozzle stem member 93 is in a normally upright configuration when valve 79 is closed and stem 93 is tilted when valve 79 is open as illustrated in FIG. 4.

The moveable cup member 80 includes a valve plate portion 82 which transversely (relative to nozzle stem member 93) extends across the flange 93A and further includes, adjacent the outer periphery of the valve plate 82, a recess 83 which is adapted to receive therein a toroidally shaped gasket 84. Optionally, the gasket 84 may be adhered to the recess by means of an adhesive or the like (not detailed).

Also, the moveable cup member 80 is provided with a circumferentially extending integral skirt portion 94 which is adapted to make slidable guiding contact with the tubular wall portions of member 85, the axial length of the skirt 94 being sufficient to provide a stabilized reciprocal sliding ability for the moveable cup 80 relative to the plate 86. The upper regions of the skirt 94 are integrally associated with the circumferentially outer portions of the valve plate 82, the cup 80 here being formed of sheet metal. A plurality of apertures 95 are defined in the member adjacent plate 86. Thus, a pressurized fill within a container 89 is in close proximity to the mouth 96 of stem 93 and a minimum flow pathway exists between the mouth 96 and the apertures 95 when the stem member 93 is in its tilted (valve open) configuration as shown in FIG. 4.

The downward turned internal edge 92 of the flange 91 of member 85 provides a rib-like circumferentially extending projection which is adapted to be in opposed relationship to, and to make a seating engagement with, the gasket 84 when the moveable cup 80 (carrying gasket 84) is in a valve closed configuration with the stem 93 in a generally upright configuration. In the valve open configuration, shown for illustration purposes in FIG. 2, the stem 93 is in its tilted configuration and the flange 93A has cammingly urged the valve plate portion 82 of moveable cup 80 downwards to provide an aperture between the edge 92 of flange 91 and the gasket 84. In this configuration, the fill within the container 89 passes through apertures 95 and into the mouth 96 of the stem 93.

Support and secondary sealing action for the stem 93 particularly when it is the tilted configuration depicted in FIG. 4 is provided by the gasket 97 through which the stem 93 extends.

Figure 5:
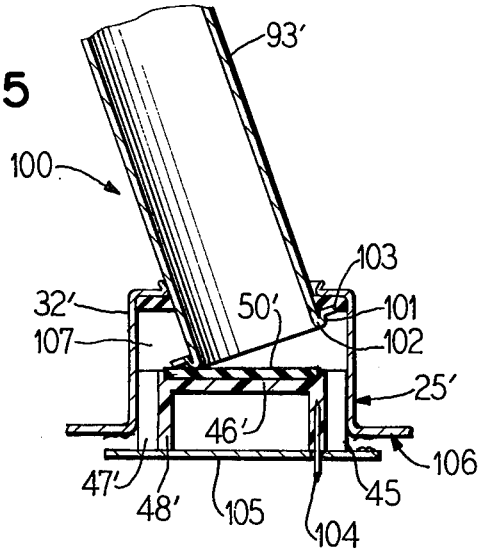
FIG. 5 is a view similar to FIG. 2, but illustrating a vertical cross sectional view of an alternative embodiment of a valve structure of the present invention, some parts thereof being broken away.

Referring to FIG. 5, there is seen another embodiment of a valve structure of the present invention which is designated in its entirety by the numeral 100 which structure 100 is similar to valve structure 21. Portions of the valve structure 100 which are similar to the valve structure 21 are similarly numbered but with the addition of prime marks thereto.

Here, however, the nozzle stem member 39' incorporates at its interior end an integral terminal flange 101 which is formed so as to include, in a circumferential region thereof adjacent to the cylindrical body of the stem 39', a downwardly (axially) projecting rib member 102 which then integrally joins radially out-turned flattened flanged region 103.

The valve structure 100 employs an internal seal plate 105 which is releasably bonded by an adhesive (not shown) to the interior projection 106 of mounting cup 25' so as to provide a gas-tight seal between fill contents of a container and working components of valve structure 100. The structure 100 provides the capacity for long shelf-life storage of fills sensitive to atmospheric gases (including moisture).

The moveable cup 45 employed in this embodiment is comparable to cup 45 as employed in the valve structure 21 except that here the apron 48' thereof is provided with an embedded, off-center, axially extending perforating needle 104. In this valve structure 100, the perforating needle 104 permits pressure equalization to be obtained in the initial valve desealing operation to facilitate release of the bonding means and separation of plate 105 from projections 106. Suitable bonding means may here be provided by solder or by organic adhesive.

The structure 100 is particularly advantageous for use in the case of highly pressurized systems because of the advantageous circumstance that the sealed structure 100 can be opened in stages in an initial desealing operation as will now be described. Thus, in a first desealing stage, the valve stem 39' is manually tilted which causes flange 101 to cammingly engage plate 46' and thereby slidably move the valve moveable cup 45' downwards and rearwardly away from gasket 43'. As this movement occurs, the needle 104 first contacts plate 105 and then penetrates same. Particularly if, at this time, the stem 39' is returned to its normally upright position, so that the needle 104 is removed or loosened relative to the perforation in plate 105, the pressures in the region 107 above plate 105 and below gasket 43' are now equalized relative to pressures inside an associated container. When the pressures are equalized, then the next or second stage of desealing can be carried out without having to overcome the pressure in the container 34 by a tilting force exerted on valve stem 39'.

Thereafter, in such second and final desealing stage, the valve stem 39' is manually tilted to an extent sufficient to cause the innermost end of apron 48' to bear against plate 105 and tilting angle of stem 39' is increased until, in effect, the pressure exerted against plate 105 is sufficient to release the bonding means so that the plate 105 is separated from projection 106, thereby unsealing the valve 100.

With valve 100 thus unsealed and in a valve opened configuration, the pressurized contents in a container flow into the interior region of stem 39' through the passageways existing between circumferentially adjacent ribs 47' and radially adjacent portions of wall 32' and apron 48' and into the mouth of stem 39' adjacent flange 101.

When the tilted stem 39' is returned to its normally closed, upright configuration, a positive seating engagement is achieved between the sealing rib 102 and the gasket member 50' resulting in a primary seal. A secondary seal which is primarily effective during valve openings to prevent leakage is achieved between the gasket 43' and adjacent portions of stem 39' and flange 101 thereof.

Figure 6:
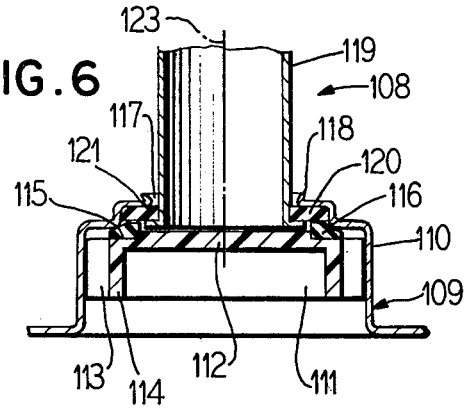
FIG. 6 is a view similar to FIG. 3, but illustrating an alternative embodiment of a valve structure of the present invention, some parts thereof being broken away.

Referring to FIG. 6, there is seen another embodiment of a valve structure of the present invention which is designated in its entirety by the numeral 108. Like valve structure 57, the valve structure 108 employs a mounting cup 109 which is conventionally mounted to a container (not shown). The central pedestal 110 of valve 108 is fitted with a moveable cup member 111 that is provided with an integrally formed valve plate 112, guide ribs 113, and apron 114. A recess 115 is defined in the peripheral top facial edge portions of the upper surface of valve plate 112 and a gasket 116 is positioned circumferentially in the recess 115. Optionally, the gasket 116 can be affixed in the recess 115 by an adhesive of the like, if desired (not shown).

An aperture 117 is provided in the central region of the pedestal 110 and an upstanding lip 118 is provided circumferentially around the aperture 117. Through aperture 117 is extended a nozzle stem member 119 which is structured similarly to, for example, the nozzle stem member 70 of valve structure 57. The nozzle stem member 119 also extends through a central aperture of a resilient gasket 120 which gasket 120 also makes abutting contact with both adjacent outer wall portions of nozzle stem member 119 and its integral flange 121. The outer perimeter of the gasket 120 is seated in the pedestal 110 adjacent the central portion thereof in a recess formed therein in radially adjacent relationship to the aperture 117.

When the nozzle stem member 119 is in its normal (valve closed) upright configuration illustrated in FIG. 6, a positive seating is achieved between the contacting respective portions of the adjacent gaskets 116 and 120 which is considered to be highly effective in achieving a gas-tight seal for the valve structure 108. In such valve closed configuration, the axial thickness (relative to the longitudinal axis 123 of the valve structure 108) of the gasket 116 is appreciably greater than the axial thickness of the flange 121 so that the flange 121 does not interfere with, or influence the attainment of, the desired sealing action between the gasket 116 and the gasket 120.

When the nozzle stem member 119 is tilted resulting in axial sliding movement of the moveable cup 111 downwards, the gasket 120 is separated from the gasket 116, thereby opening the valve structure 108. In the valve open (stem 119 tilted) configuration, a secondary sealing action is maintained between the gasket 120 and contacting portions of the flange 121 and stem member 119. In addition, the gasket 120 exerts a positioning and securing function in relation to the stem member 119.

Although the teachings of my invention have herein been discussed with reference to specific embodiments, it is to be understood that these are by way of illustration only and that others may wish to utilize my invention in different designs or applications.

I claim:

1. A fluid dispensing valve structure for dispensing the viscous contents of a pressurized container comprising:

a valve mounting cup peripherally sealing securable to said pressurized container and including wall portions defining an interior valve receiving chamber with central upper and lower longitudinally spaced apertures defined therein;

a first resilient seal member positioned around and radially adjacent said upper aperture in said valve receiving chamber;

an elongated tubular nozzle means having a dispensing orifice in one end thereof and having a second opposed and radially outwardly flanged end extending through said upper aperture and yieldingly sealingly supported by said first resilient seal member, said second end being adapted to make seating engagement with said first resilient seal member when said tubular nozzle means is in a normally generally straight upright extended position relative to said valve mounting cup;

a moveable valve cup means longitudinally reciprocally slidably carried within said valve receiving chamber and normally biasable into an adjacent relationship with said second end to form a seal means for normally sealing the contents of said container with respect to said valve mounting cup;

said contents of said pressurized container being dispensable through said valve receiving chamber when said one end is tiltably displaced relative to said generally straight upright extended position by an external deflecting operating force applied thereagainst, thereby opening said seal means;

seal moveable valve cup member including:

(A) a valve plate portion positioned to extend across said second end having perimeter regions, (B) a second resilient seal member positioned circumferentially on at least said perimeter regions adjacent said second end arranged to make seating engagement with a region extending circumferentially around said second end said region being comprised of at least one of said first resilient seal member, said second end, and said wall portions in said valve receiving chamber, when said tubular nozzle means is in said generally straight upright extended position, (C) guidance means for guiding said moveable valve cup member along said wall portions in said valve receiving chamber during said reciprocal sliding movements;

channel means defined cooperatively by said moveable valve cup means and by adjacent portions of said walls for passage of said contents therethrough to said second end, and existing at least when said nozzle means is so tiltably displaced; and the interrelationship between said moveable valve cup means and said valve mounting cup being such that a substantially unobstructed flow of said contents through said valve structure occurs when said one end is so tiltably displaced.

2. The valve structure of claim 1 wherein said second end further includes a circumferentially continuous and longitudinally extending annular rib means which is opposed to said second resilient seal member and which engages therewith when said tubular nozzle means is in said generally straight upright extended position.

3. The valve structure of claim 1 wherein, when said nozzle means is in said generally straight upright extended position, said second end makes seating engagement with each of said first and said second resilient seal members.

4. The valve structure of claim 1 wherein said wall portions include in said valve receiving chamber a circumferentially continuous and longitudinally extending annular rib means located in a radially outer adjacent relationship to said first resilient seal member and also in a longitudinally opposed relationship to said second resilient seal member and which rib means engages therewith when said tubular nozzle means is in said straight upright extended position.

5. The valve structure of claim 1 wherein said first and said second resilient seal members are in an axially opposed relationship to one another.

6. The valve structure of claim 1 further including internal seal plate means and adhering means functionally bonding said plate means to said valve mounting cup over said lower aperture, said adhering means being rupturable by longitudinal movement of said moveable cup member against said seal plate means when said moveable cup member is initially actuated by tiltable displacement of said tubular nozzle means.

7. The valve structure of claim 1 so secured to said pressurized container and wherein said pressurized contents provided yielding biasing means urging formation of said seal means.

8. A device for dispensing a highly viscous liquid comprising:

(A) a pressurizable container, (B) a fluid dispensing valve structure secured to said container and having fluid communication with the interior thereof, said valve structure being as described in claim 1.

9. The fluid dispensing valve structure of claim 1 wherein said passage takes place through said lower aperture and said passage occurs longitudinally through at least portions of said guidance means when said one end is so tiltably displaced.

10. The fluid dispensing valve structure of claim 1 wherein said passage takes place through opening means defined in said walls generally radially adjacent said first and said second resilient seal members and wherein said passage occurs transversely between a spaced defined between said first and said second resilient seal means when said one end is so tiltably displaced.

11. The valve structure of claim 1 further including camming means centrally upstanding from said base portion and slidably engageable with portions of said second end when said one end is so tiltably displced, whereby longitudinal deflection of said moveable valve cup member occurs when said second end slides therealong.

12. The valve structure of claim 11, wherein said camming means is conically shaped.

13. A fluid dispensing valve structure for dispensing the viscous contents of a pressurized container comprising:

a valve mounting cup peripherally sealingly securable to said pressurized container and including wall portions defining an interior valve receiving chamber with central upper and lower longitudinally spaced apertures defined therein;

a first resilient seal member positioned radially adjacent said upper aperture in said valve receiving chamber;

an elongated tubular nozzle means having a dispensing orifice in one end thereof and having a second opposed end extending through said upper aperture and yieldingly supported by said first resilient seal member in a normally generally straight upright extended position relative to said valve mounting cup, said second end further including a radially outwardly extending flange means, and one side of said flange means being adapted to make seating engagement circumferentially about said second end with said first resilient seal member when said nozzle means is in said generally straight upright extended position;

a moveable valve cup means reciprocally slidably carried within said valve receiving chamber and normally biasable into an adjacent relationship with said second end to form a seal means therewith for normally sealing the contents of said container with respect to said valve mounting cup;

said contents of said pressurized container being dispensable through said valve structure when said one end is tiltably displaced relative to said generally straight upright extended position by an external deflecting operating force applied thereagainst, thereby opening said seal means;

said moveable valve cup member including:

(A) a valve plate portion positioned to extend across said second end having perimeter regions, (B) a second resilient seal member positioned circumferentially on at least said perimeter regions adjacent said second end and adapted to make seating engagement with an opposed side of said flange means circumferentially about said second end when said tubular nozzle means is in said generally straight upright extended position, (C) guidance means for guiding said moveable valve cup member along said wall portions in said valve receiving chamber during said reciprocal sliding movements;

channel means defined by said moveable valve cup means and by adjacent portions of said walls in said valve receiving chamber for passage of said contents therethrough to said second end, and existing at least when said tubular nozzle means is so tiltably displaced; and the interrelationship between said moveable valve cup means, and said valve mounting cup being such that a substantially unobstructed flow of said contents through said valve structure occurs when said one end is so tiltably displaced.

14. The valve structure of claim 13 further including camming means centrally upstanding from said base portion and slidably engageable with portions of said second end when said one end is so tiltably displaced, whereby longitudinally deflection of said moveable valve cup member occurs when said second end slides therealong.

15. The valve structure of claim 13 further including internal seal plate means and adhering means functionally bonding said plate means to said valve mounting cup, over said lower aperture, said adhering means being rupturable by longitudinal movement of said moveable cup member against said seal plate means when said moveable cup member is initially actuated by tiltable displacement of said tubular nozzle means.

16. A fluid dispensing valve structure for dispensing the viscous contents of a pressurized container comprising:

a valve mounting cup peripherally sealingly securable to said pressurized container and including wall portions defining an interior valve receiving chamber with a central upper aperture defined therein and further defining in said valve receiving chamber a circumferentially continuous and longitudinally extending annular rib means in radially spaced relationship to said central aperture, a first resilient seal member positioned radially between said upper aperture and said annular rib means in said valve receiving chamber;

an elongated tubular nozzle means having a dispensing orifice in one end thereof and having a second opposed end extending through said upper aperture and yieldingly supported by said first resilient seal member in a normally generally straight upright extended position relative to said valve mounting cup, said second end further including a radially outwardly extending flange means, and one side of said flange means being adapted to make seating engagement circumferentially about said second end with said first resilient seal member when said nozzle means is in said generally straight upright extended position;

a moveable valve cup member reciprocally longitudinally slidably carried within said valve receiving chamber and normally biasable into an adjacent relationship with said second end to form a seal means about said second end for normally sealing the contents of said container with respect to said valve mounting cup;

said contents of said pressurized container being dispensable through said valve structure when said one is tiltably displaced relative to said generally operating force applied thereagainst, thereby opening said seal means;

said moveable valve cup member including:

(A) a valve portion positioned to extend across said second end having perimeter region, (B) a second resilient seal member positioned circumferentially on at least said perimeter region portion and adapted to make seating engagement with said annular rib means circumferentially about said second end when said nozzle means is in said generally straight upright extended position, (C) sidewall means for guiding said moveable valve cup member along said wall portions in said valve receiving chamber during said reciprocal sliding movements;

side aperture means defined in said walls generally radially adjacent to said first and said second resilient seal members for passage of said contents therethrough transversely to said second end when said tubular nozzle means is so tiltably displaced, and the interrelationship between said moveable valve cup means and said valve mounting cup being such that a substantially unobstructed flow of said contents through said valve structure occurs when said end is so tiltably displaced.

* * * * *